US005214950A

United States Patent [19]

Grobbenhaar

[11] Patent Number: 5,214,950

[45] Date of Patent: Jun. 1, 1993

[54] METHOD AND APPARATUS FOR BENDING A MULTIPLE TUBE

[75] Inventor: Hermanus G. Grobbenhaar, Herkenbosch, Netherlands

[73] Assignee: Grand Prix Silencers BV, Melick en Herkenbosch, Netherlands

[21] Appl. No.: 863,480

[22] Filed: Apr. 2, 1992

Related U.S. Application Data

[63] Continuation-in-part of Ser. No. 548,562, Jul. 5, 1990, abandoned.

[30] Foreign Application Priority Data

Jul. 5, 1989 [NL] Netherlands ..... 8901713

[51] Int. Cl.[5] ..... B21D 9/05

[52] U.S. Cl. ..... 72/150; 72/370

[58] Field of Search ..... 72/369, 150, 398, 466, 72/370

[56] References Cited

U.S. PATENT DOCUMENTS 4,009,601 3/1977 Shimizu .
4,137,743 2/1979 Schwarze ..... 72/369
4,538,436 9/1985 Schwarze ..... 72/150

FOREIGN PATENT DOCUMENTS 2732046 2/1974 Fed. Rep. of Germany ..... 72/369
3415077 9/1985 Fed. Rep. of Germany .

*Primary Examiner*—Lowell A. Larson
*Assistant Examiner*—Michael J. McKeon
*Attorney, Agent, or Firm*—Stevens, Davis, Miller & Mosher

[57] ABSTRACT

In the bending in a bending plane of a multiple tube having a plurality of compartments extending side-by-side in the longitudinal direction of the tube, a bending location is moved progressively along the tube and during bending a mandrel is located inside each said compartment at the bending location. To improve control of the tube shape, during at least part of the bending the position of at least one of the mandrels relative to the tube at the bending location varies in dependence on at least one parameter of the bending. At least one of said mandrels may be free to move, under constraint by a resilient force, in the longitudinal direction of the tube.

18 Claims, 1 Drawing Sheet

METHOD AND APPARATUS FOR BENDING A MULTIPLE TUBE

This application is a continuation-in-part of application Ser. No. 548,562, filed Jul. 5, 1990, now abandoned.

BACKGROUND OF THE INVENTION

1. Field of the Invention

The invention relates to a method for bending in a bending plane a multiple tube having a plurality of compartments extending side-by-side longitudinally along the tube. During the bending a bending mandrel extends into each of the compartments of the tube. The invention also relates to an apparatus for carrying out the method and to a bending mandrel for use in such apparatus.

2. Description of the Prior Art

A multiple tube means in this description and claims a tube which comprises a plurality of conduits, herein called compartments, joined together into the integral tube and extending longitudinally along the tube. The compartments are typically separated from each other by one or more partition walls. The partition wall may be a double wall, in which case each compartment is then a complete single tube in itself, or the partition wall may be a common wall between two compartments. Typically, such a tube is of metal, e.g. steel.

A known multiple tube is a so-called DD-tube which comprises two compartments, each with a D-shaped cross-section, joined to each other with the flat parts facing each other. The section of the DD-tube may be circular, elliptical or another shape. The partition wall between them is a common wall.

DD-tube is increasingly being used for exhaust pipes in the car industry. The attraction of DD-tube is that this form of tube is suitable for combustion engines with high specific power and takes up little space in a car, thus increasing the design flexibility needed e.g. for aerodynamic styling.

DD-tube is usually manufactured as straight tube with two compartments and then modified by, among other steps, a bending operation into the required shape of, for example, an exhaust pipe.

A method is known in actual practice in which DD-tube is bent in a bending plane transverse to the partition between the two D-shaped compartments. In the known method a bending mandrel is inserted into each of the D-shaped compartments. For this purpose, each bending mandrel has an outer sleeve extending with an essentially constant cross-section transverse to the longitudinal axis, this cross-section corresponds to the cross-section of the D-shaped compartment. The bending mandrel has a flat front side on the end facing towards the bend; the transition area between the outer sleeve and the flat front side is slightly rounded off. A circular bending template is used. The tube is bent round the template. Each bending mandrel is inserted far enough into the tube so that the foremost boundary of the outer sleeve of the mandrel lies approximately 2–5 mm in front of the radius through the tangent point of the tube with the bending template. The correct position of each of the bending mandrels is determined by experiment for each tube size, bending radius etc. and is thereafter not again altered. If the bending mandrel is inserted further into the tube than the above mentioned position, then a bulge occurs in the bend formed which is an impression of the said transition area. If a bending mandrel is inserted even further into the tube, then there is a risk of the bending mandrel being drawn by the tube into the bend during bending, which obstructs the bending operation and can cause damage to the bending mandrel and other parts of the bending apparatus. With the known method, bends of approximately 90° may be formed, that is to say that the multiple tube is bent through 90°. When a larger bend is made, the outer wall of the DD-tube at the inside of the bend displays wrinkles and the compartment at the outside of the bend will become flattened. One inconvenience arising from this is that when it is used as exhaust pipe, the gas balance between the combustion engine cylinders connected to the one D-shaped compartment and the cylinders connected to the other D-shaped compartment is disturbed.

Another disadvantage of the known method occurs when it is attempted to bend the DD-tube in two opposing bends in the same bending plane, i.e. when forming an S-shaped bend. Because the position of the bending mandrel at the inside of the bend may be different from the position of the bending mandrel at the outside of the bend, when making an S-shaped bend, the bending mandrels have to be moved from one compartment to the other during the bending operation. This results in lost production time.

U.S. Pat. No. 4,009,601 relates to a method and an apparatus for bending a double pipe, in particular two concentric round pipes. A metal core, having an outer metal core and an inner metal core is inserted into the two concentric round pipes to a prescribed position and is fixed thereon during the bending operation. The inner metal core and outer metal core are rigidly fixed relative to each other by means of a metal rod and a connecting flange.

DE-A-2 732 046 relates to a method for bending two pipes, one inserted inside the other, and to an apparatus for carrying out the method. According to this publication two mandrels are used, a round mandrel inserted inside the smaller pipe, and a crescent shaped mandrel between the smaller and the larger pipe. Both mandrels are connected to a support via rigid rods and are kept at their locations while bending the pipes.

SUMMARY OF THE INVENTION

The object of the invention is to provide a method for bending multiple tube which makes it possible to bend a multiple tube into at least a right angled bend, in which the cross-sectional shape of the compartments of the multiple tube essentially do not alter and no wrinkles occur in the outer wall of the tube.

Another object of the invention is also to provide a method in which an S-shaped bend may be made without it being necessary to move the bending mandrel from one compartment to the other.

In accordance with the invention in one aspect, there is provided a method of bending in a bending plane a multiple tube wherein, relative to the tube, a bending location is moved progressively along the tube and during bending a mandrel is located inside each said compartment at the bending location The method is characterized in that during at least part of the bending the position of at least one of said mandrels relative to the tube at the bending location varies in dependence on at least one parameter of the bending.

It has been found that the bending mandrels should not be kept in a fixed position, but should be inserted in a location which depends on at least one bending parameter of the respective compartment occurring at any moment. Tests have indicated that, using the method in accordance with the invention, a DD-tube with a double partition wall may be made into a bend of over 140° without any wrinkling in the DD-tube outer wall at the inside of the bend and without the section of each of the composite D-tubes changing shape to any appreciable extent.

The bending mandrels may be permitted to move relatively to each other to adopt the best positions in the tube. Resilient restraint may be applied to each mandrel. Alternatively, or additionally, at least one of the bending mandrels may be pushed to the desired location.

The position of the bending mandrel in each compartment is varied during the bending operation, to depend e.g. on the bending radius. Therefore an S-bend may be made just by changing the position of the bending mandrel and it is not necessary to remove the bending mandrels collectively from the multiple tube and then reinsert the bending mandrels collectively into another position in the multiple tube. The speed at which the method in accordance with the invention may be operated is consequently increased.

A further embodiment of the method in accordance with the invention is characterized in that one of the bending parameters is the length of the part of the tube already bent.

With the known method, assuming a DD-tube with circular section, during bending a flattening of the section occurs, which increases as the length of the part of the tube already bent, i.e. the angle at which the tube is bent, increases. In addition, the partition wall displaces relative to its original position. With the known method, for a bend of 90°, the smallest diameter of the section is approximately 8% smaller than the largest diameter.

With the method in accordance with the invention, it has been found for example that the smallest diameter of the section for a bend of over 140° is only approximately 3% smaller than the largest diameter.

In the method according to the invention wherein a first one of said mandrels is located in a first said compartment which is bent in said bending to a first radius of curvature and a second one of said mandrels is located in a second one of said compartments which is bent in said bending to a second radius of curvature larger than said first radius of curvature, it is preferred that, during at least an initial phase of said bending, said first mandrel is located, relative to said bending location, further along said tube than said second mandrel in the direction opposite to the direction of movement of said bending location relative to the tube. In said initial phase of the bending, the amount of bending of the tube is preferably not more than 20°. Preferably, after an initial phase of the bending, at least one of said mandrels is shifted, relative to said bending location, from a first location to a second location, which is further along the tube than said first location in the direction opposite to the direction of movement of said bending location relative to the tube.

This embodiment can be explained as follows. While bending, the wall of a compartment extending on the outside of a bend, is elongated less for a bend with small bending radius than for a bend with great bending radius. During the initial phase, material mainly flows to the outside of the bend in the circumferential direction and much less in longitudinal direction. This may result in rupture of the wall unless the position of the bending mandrel is adapted in accordance with the bending radius and the angle of the bend during the initial phase.

It has been shown that in practice good results are obtained when the initial phase corresponds to a bend of 20° or less. After bending by 20° there is sufficient supply of material in the longitudinal direction to prevent rupture. A bending mandrel is thus preferably, after the initial phase, pushed forward by an external pushing force to prevent flattening of the cross-section of the corresponding compartment. In practice it has been shown that a forward motion of about two percent of the bending radius is sufficient to maintain the original cross-section to an acceptable degree as mentioned below.

Preferably the rate of increase of the pushing force and/or the final value of the pushing force is higher as the speed of bending of the multiple tube is higher.

This embodiment of the invention has shown in practice to give good results. It is assumed that, when applying a higher speed of bending, the forces between the bending mandrel and the walls of the compartment are higher due to the increasing deformation speed of the material. To compensate for those higher forces, higher pushing forces are required.

At the same time the invention relates to an apparatus for bending in a bending plane a multiple tube having a plurality of compartments extending side-by-side in the longitudinal direction of the tube, having (a) a support for supporting said tube during bending,
(b) bending means for bending said tube around said support at a bending location which relative to said tube is moved progressively along said tube,
(c) a plurality of mandrels insertable respectively into said compartments so as to support said tube internally during bending,
(d) locating means for said mandrels for maintaining said mandrels at the bending location, said locating means permitting displacement, during bending, of at least two said mandrels relative to each other in the longitudinal direction of said tube.

Thus the apparatus may provided with compensating means which, during bending, allow a displacement of at least two of the bending mandrels longitudinally relative to one another. This means that at any moment during bending the current position of a bending mandrel in a compartment may be adjusted to the bending radius occurring at that moment and at that place.

In the known apparatus which makes use of bending mandrels, these mandrels are joined to the apparatus frame by fixing means and during bending the bending mandrels extend from a straight part of the tube to be bent to near the part of the tube being bent.

Preferably the mandrel locating means is adapted to apply a resilient force to at least one of the relatively displaceable mandrels, thereby permitting its displacement in the longitudinal direction of said tube. Suitably an elastically extensible element connects at least one of said relatively displaceable mandrels to a fixed element (e.g. a frame part). The elastically extensible element may be a metal tension rod. The elastically extensible element allows a displacement of the bending mandrel longitudinally, whereby the position of each bending mandrel which is provided with such a component is determined by equilibrium between the spring force of the element and the force which is exerted on the bending mandrel by the walls of the respective compartment.

A particularly simple embodiment is characterised in that the elastically extensible element is a tension rod or spring. A rod offers the advantage of simplicity and is not susceptible to fouling by chips, chippings etc.

When using the apparatus for bending DD-tube good results are achieved in a specific embodiment in which at least one said mandrel comprises a body portion having a constant cross-sectional shape in the longitudinal direction of said tube and a head portion attached to said body portion and having a first bounding face directed outwardly relative to a centre of curvature of said tube when bent and curving in said bending plane essentially in conformity with the curve formed during bending in a wall of said tube which is adjacent said first bounding face during bending. Tests with this embodiment have indicated that bending thick walled DD-tube at large angles is well possible without damaging the tube walls or without the section of each of the D-shaped compartments changing shape to any appreciable extent.

In particular for making S-bends, the bending head and bending body may be joined together so that they tilt relatively on a tilting axis which extends transversely to the bending plane. However, in certain applications, the tilting mechanism needed for this may be susceptible to contamination which adversely affects operation.

A further simplification of the apparatus is obtained with an embodiment which is characterised in that the bending head has a boundary face which is directed towards the partition wall and extends essentially according to a bend to be made in the partition wall. With this embodiment, the bending head may be joined rigidly to the bending body which makes the apparatus also useable for multiple tube in which material particles loosen from the inside wall during bending.

A further preferred feature of the apparatus is characterised in that the head portion of the mandrel tapers to a point at its end directed away from the bending body. Because the bending head tapers to a point, it is also possible to make a bend transverse to the above mentioned bending plane without any need to change or replace the two bending mandrels. In this bending operation, the two bending mandrels will occupy a like position longitudinally relative to the DD-tube.

Because during bending the bending mandrels are displaceable longitudinally along the tube, the bending mandrels do not have to be pulled out of the tube for transfer from one bending plane to another bending plane transverse to it, but it is sufficient to rotate the tube by 90° around the longitudinal direction of the tube. In this embodiment the apparatus makes it possible to bend the tube in any desired plane relative to the partition wall.

BRIEF INTRODUCTION OF THE DRAWINGS

The invention will now be illustrated by way of non-limitative example with reference to the drawings. In the drawings.

DESCRIPTION OF THE PREFERRED EMBODIMENTS

Figure 1:
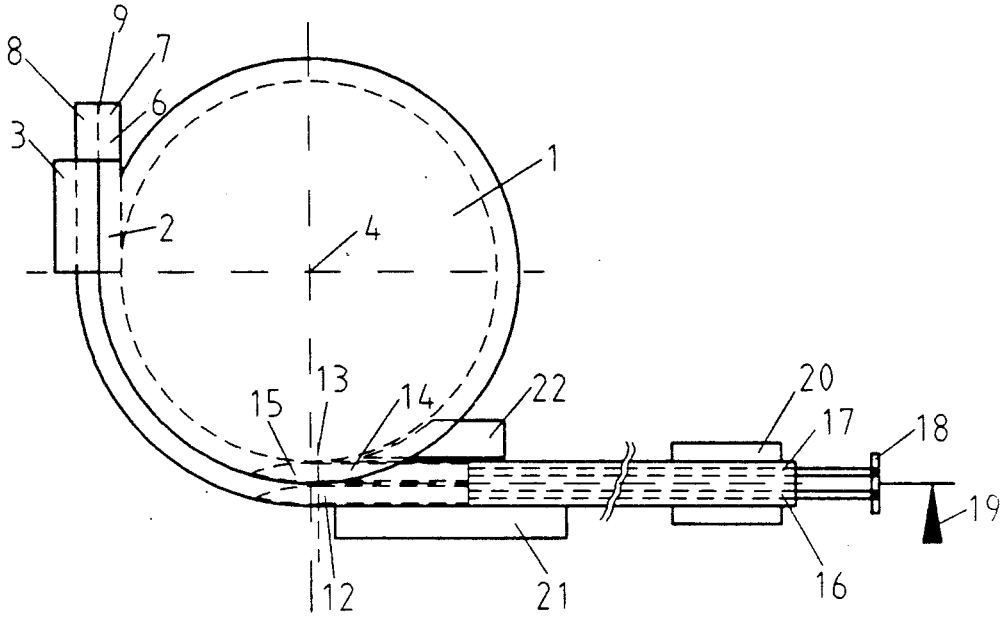
FIG. 1 is a section at the bending plane of a DD-tube which is clamped in an apparatus in accordance with the invention.

FIG. 1 shows a radial bending block 1 of circular periphery which forms the support component in the apparatus for the tube being bent. The radial bending block 1 has a part 2 extending tangentially which acts together with the clamping apparatus 3, for the clamping of the tube to be bent. The radial bending block 1 has a recess in a semi-circular shape at its circumference for reception of the tube to be bent. The radial bending block 1 is able to rotate together with the clamping apparatus 3 around an axis 4 which is perpendicular to the plane of the drawing. In the condition drawn, the radial bending block and clamping apparatus has been rotated by 90° clockwise relative to an initial position.

A DD-tube 6 is clamped in the apparatus. The DD-tube comprises two single D-tubes 7 and 8 which are separated from each other by a common partition wall 9. The rearmost end of the tube is clamped by means of a gripper 20. The gripper 20 is free to move during bending in the longitudinal direction of the tube. At the same time the gripper 20 can rotate around an axis which coincides with the longitudinal direction of the tube. In order to prevent deflection of the tube during bending and in order to control the bending process, the tube is supported by a sliding shoe 21. An ironing die 22 guides the tube to close to the circumference of the radial bending block and prevents wrinkles occurring in the first instance.

The bending means, i.e. the support 1, the clamp 3 and the shoe 21, cooperate to bend the tube at a bending location which moves progressively along the tube as the support 1 rotates.

In known methods and apparatus, the sliding shoe is freely slidable on guides. However, in order to better control the flow of material in the longitudinal direction it is advantageous to drive the sliding shoe so that it exerts a pushing or a pulling force on the wall of the tube. Good results are obtained with a pushing force.

A bending mandrel 12 extends into D-tube 8; a bending mandrel 13 extends into D-tube 7. The mandrels are located at the bending location. Each of the bending mandrels 12 and 13 comprises a bending body 14 and a bending head 15. The bending mandrels 12 and 13 are, by means of steel tension rods 16 and 17 respectively, joined hingedly to a rocker arm 18, which in turn is hingedly joined with the frame 19 of the apparatus, not shown in detail. The tension rods 16 and 17 form elastically extensible elements which apply resilient constraint to the mandrels 12,13 to ensure position adjustment of each of the bending mandrels to the bending parameters occurring in each of the two compartments.

In the apparatus shown, during bending the walls of the compartments 7,8 tend to drag the mandrels forwardly (i.e. towards the clamp region 2,3). On the other hand the outer wall of the D-tube 8 extending at the outside of the bend exerts a force directed towards the rear on bending mandrel 12. This force causes, as a result of the elastic extension of the tension rod a slight rearward displacement of bending mandrel 12. Through intervention of tension rod 16, rocker arm 18 and tension rod 17, this rearward displacement of bending mandrel 12 results in a forward displacement of bending mandrel 13. In corresponding manner, the partition wall 9 influences the position of bending mandrel 13 and through intervention of the tension rods 16,17 and the rocker arm 18 influences the position of bending mandrel 12. In this embodiment, the mandrels are permitted to move, under the constraint of the resiliently extensible rods 16,17 to adopt the most suitable relative positions throughout the bending operation.

In an initial phase of the bending, mandrels 12 and 13 are in the same position, i.e. touching a plane perpendicular to the longitudinal direction of the DD-tube. Once the bending process has started, mandrel 12 is moved further forward ahead of mandrel 13. After a bend of approximately 20° has been made, a quiescent state is reached and there is no more relative movement of mandrels 12 and 13. Mandrel 12 remains in front of mandrel 13 during the completion of the bending.

As an alternative, the effect of the forces applied to the two mandrels 12,13 is that the mandrel 13 in the compartment 7, which is bent to a smaller radius than the compartment 8, is located further forward initially than the mandrel 12, i.e. further along the tube in the direction of movement of the tube (which is opposite to the relative direction of movement of the bending location). This aids the effect of the support given to the tube walls by the mandrel during this phase. After this initial phase, which is preferably not more than 20° of bending, the rocker arm 18 is pushed forwardly slightly, by means not shown, i.e. is pushed to the left as seen in FIG. 1. The mandrel 13 at this time cannot move forwardly, due to its contact with the tube. Consequently, the mandrel 12 is pushed forwardly by the rod 16 into a more forward position beyond the position of mandrel 13. As discussed above, the amount of this shift may be slight, e.g. about 2% of the bending radius. Thereafter mandrel 12 remains in front of mandrel 13. The effect is to improve the control of the shape of the tube during bending.

As a result of this play of forces described and of the absolute and relative positions of the bending mandrels arising from it, it is possible with the apparatus in accordance with the invention to bend a multiple tube at an angle greater than 90° without the section of each of the compartments of the multiple tube being deformed to any inconvenient extent.

For making an S-bend the gripper 20 and the two bending mandrels 12, 13 including the tension rods 16, 17 and the rocker arm 18 rotate 180° around the axis in the longitudinal direction of the tube. After rotation, the D-tube 8 with the bending mandrel 12 inside it lies against the radial bending block and the D-tube 7 with the bending mandrel 13 inside it lies against the sliding shoe 21. After this the bending process may be continued, whereby in accordance with the play of forces described above the bending mandrels again take up the correct position.

Figure 2:
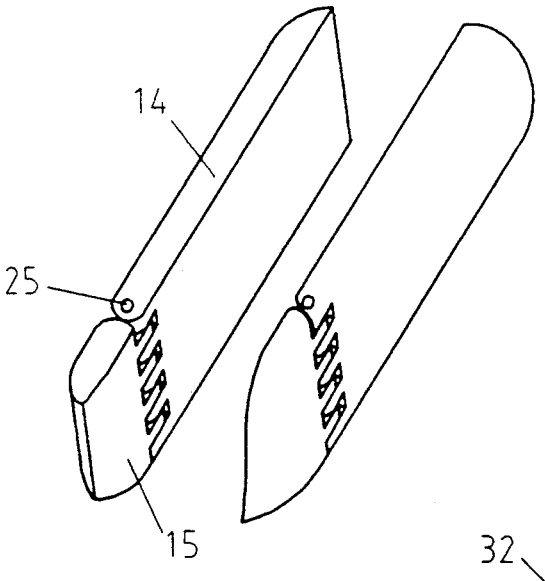
FIG. 2 is a view of the bending mandrel for use in an apparatus in accordance with the invention.

FIG. 2 shows a bending mandrel which comprises a bending body 14 and bending head 15 joined to it. The bending body 14 and the bending head 15 are tiltably joined together by means of a tilting pin or hinge 25. The sections of the bending body 14 and of the bending head 15 essentially correspond with the section of the relevant compartment of the multiple tube to be bent. The bending body may be joined to the frame of the apparatus by a tension spring or by means of a elastically deformable tension rod as described.

Figure 3:
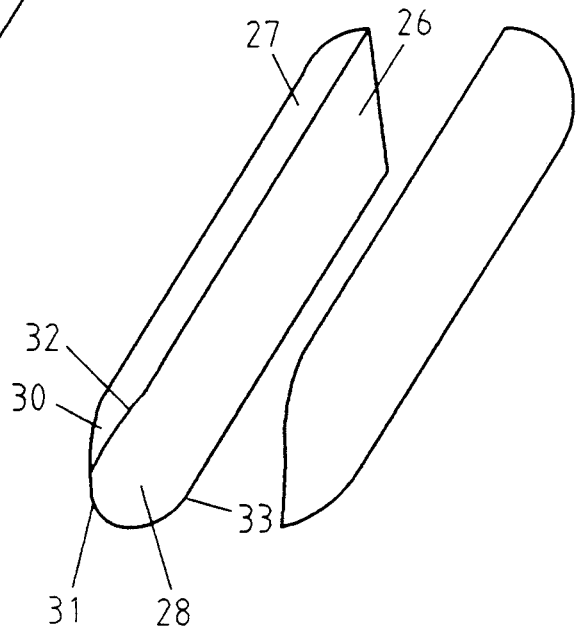
FIG. 3 is a view of another embodiment of a bending mandrel for use in an apparatus in accordance with the invention.

FIG. 3 shows another embodiment of a bending mandrel useful in the invention. The bending body is again indicated by 14 and the bending head is indicated by 15. Two identical bending mandrels are used. The bending body has a constant cross-section along its length which essentially corresponds with the section of the compartment to be bent.

For a bending mandrel of a DD-tube, the bounding face 26 is a flat face which cooperates with the partition wall 9 of the DD-tube; the bounding face 27 has a shape corresponding with the outer wall of a single D-tube. The bending head has a bounding face 28 curved in one plane which adjoins the flat bounding face 26. During bending, the curved face 28 cooperates with the partition wall 9 and is shaped to conform to the curve created in the partition wall 9. At the same time the bending head 15 has an end face 30 which is curved in two mutually perpendicular directions, and on the one hand is curved to conform to the shape of the outer wall of the tube when bent and on the other hand is curved according to the bending radius of the bend to be made. When bending a DD-tube, two such identical bending mandrels are used, and the face 28 of one bending mandrel and the face 30 of the other bending mandrel take part in the bending process. The two mandrels are therefore each reversible.

The faces 30 and 28 taper to a common point 31. This makes it possible, by rotating the gripper 20 at an angle of 90° relative to the position drawn in FIG. 1, to bend the tube in a bending plane parallel to the partition wall 9. The edges 32 and 33 respectively then take part in the bending process. It is also possible to bend at angles of rotation of the gripper 20 other than 90°.

Just as with the bending mandrel in FIG. 2, with the bending mandrel in FIG. 3 the elastically extensible element may also take the form of a tension spring or a tension rod.

What is claimed is:

1. Apparatus for bending in a bending plane a multiple tube having a plurality of compartments extending side-by-side in the longitudinal direction of the tube and being rigidly fixed to each other along their entire lengths, having (a) a support for supporting said tube during bending, (b) bending means for bending said tube around said support at a bending location which relative to said tube is moved progressively along said tube, (c) a mandrel insertable respectively into each said compartment so as to support said tube internally during bending, (d) locating means for said mandrels for maintaining said mandrels at the bending location and for moving a first mandrel in a compartment which is to be bent to a larger radius than another compartment with a second mandrel therein to a position forward of a second mandrel in another compartment and maintaining the relative positions of the mandrels during the completion of the bending.

2. Apparatus according to claim 1 wherein said locating means is adapted to apply a resilient force to at least one of said relatively displaceable mandrels, thereby permitting its displacement in the longitudinal direction of said tube.

3. Apparatus according to claim 2 wherein said locating means comprises an elastically extensible element connecting at least one of said relatively displaceable mandrels to a fixed element.

4. Apparatus according to claim 3 wherein said elastically extensible element is a metal tension rod.

5. Apparatus according to claim 1 wherein said locating means comprises means for applying a pushing force to at least one said mandrel to shift its location, relative to said bending location, in the longitudinal direction of said tube.

6. Apparatus according to claim 1 wherein at least one of said mandrels comprises a body portion having a constant cross-sectional shape in the longitudinal direction of said compartment and a head portion attached to said body portion and having a first bounding face curving in said bending plane essentially in conformity with the curve formed during bending of an outside wall of said compartment which is adjacent said bounding face during bending.

7. Apparatus according to claim 6 wherein said head portion of said mandrel has a second bounding face directed opposite to said first bounding face and curving in said bending plane essentially in conformity with the curve formed during bending of an outside wall of said compartment which is adjacent said second bounding face during reverse bending, with one of said first and second bounding faces being directable towards the center of curvature.

8. Apparatus according to claim 6 wherein said head portion of sad mandrel tapers to a point at its end remote from said body portion.

9. In a method of bending in a bending plane a multiple tube having a plurality of compartments extending side-by-side in the longitudinal direction of the tube and rigidly fixed to each other along their entire lengths, wherein, relative to the tube, a bending location is moved progressively along the tube and during bending a mandrel is located inside each said compartment at the bending location, the improvement that the mandrel in a compartment which is to be sent to a larger radius than a compartment with another mandrel therein is moved forward of the other mandrel in the longitudinal direction of the tube during at least a portion of the bending and is maintained forward of said other mandrel during the completion of the bending and that during at least part of the bending the position of at least one of said mandrels relative to the tube at the bending location varying in dependence on at least one parameter of the bending.

10. A method according to claim 9 wherein said at least one parameter of the bending is the length of the tube portion which has already been bent in the bending.

11. A method according to claim 9 wherein at least one of said mandrels is biased to move relative to the other, under constraint by a resilient force, in the longitudinal direction of the tube, during bending.

12. A method according to claim 9 wherein a first one of said mandrels is located in a first said compartment which is bent in said bending to a first radius of curvature and a second one of said mandrels is located in a second one of said compartments which is bent in said bending to a second radius of curvature larger than said first radius of curvature, and during at least an initial phase of said bending, said first mandrel is located, relative to said bending location, further along said tube than said second mandrel in the direction opposite to the direction of movement of said bending location relative to the tube.

13. A method according to claim 12 wherein in said initial phase of the bending, the amount of bending of the tube is not more than 20°.

14. A method according to claim 9 wherein, after an initial phase of the bending, at least one of said mandrels is shifted, relative to said bending location, from a first location to a second location, which is further along the tube than said first location in the direction opposite to the direction of movement of said bending location relative to the tube.

15. A method according to claim 14 wherein at the end of said initial phase, said at least one mandrel which is shifted has applied to it an external pushing force, to cause the shift.

16. A method of bending in a bending plane a multiple tube having a plurality of compartments extending side-by-side in the longitudinal direction of the tube and rigidly fixed to each other along their entire lengths, comprising the steps of (i) locating said tube at a bending location having bending means adapted for bending the tube, (ii) locating a mandrel in each of said compartments of the tube at said bending location, said mandrels being adapted to support the tube during bending and move relative to each other, (iii) relatively moving said tube and said bending location, while causing said bending means progressively to bend a predetermined length of the tube, (iv) during step (iii) moving a first mandrel in a first compartment which is to be bent to a larger radius than a second compartment with a second mandrel therein to a position forward of said second mandrel in said second compartment in the longitudinal direction of the tube and maintaining said first mandrel forward of said second mandrel during completion of the bending in the longitudinal direction of the tube.

17. A method of bending in a bending plane a multiple tube having a plurality of compartments extending side-by-side in the longitudinal direction of the tube and rigidly fixed to each other along their entire lengths, comprising the steps of (i) locating said tube at a bending location having bending means adapted for bending the tube, (ii) locating a mandrel in each of said compartments of the tube at said bending location, said mandrels being adapted to support the tube during bending and move relative to each other, (iii) relatively moving said tube and said bending location, while causing said bending means progressively to bend a predetermined length of the tube, (iv) during step (iii) moving a first mandrel in a first compartment which is to be bent to a smaller radius than a second compartment with a second mandrel therein to a position forward of said second mandrel in a second compartment in the longitudinal direction of the tube and bending the tube a portion of a predetermined bend on a portion of the tube and then moving said second mandrel forward of the position of said first mandrel and completing the bend.

18. Apparatus for bending in a bending plane a multiple tube having a plurality of compartments extending side-by-side in the longitudinal direction of the tube and being rigidly fixed to each other along their entire lengths, having (a) a support for supporting said tube during bending, (b) bending means for bending said tube around said support at a bending location which relative to said tube is moved progressively along said tube, (c) a mandrel insertable respectively into each said compartment so as to support said tube internally during bending, (d) locating means for said mandrels for maintaining said mandrels at the bending location and moving a first mandrel in a compartment which is to be bent to a smaller radius than another compartment with a second mandrel therein to a position forward of a second mandrel in said second compartment in bending the tube a portion of a predetermined bend and moving said second mandrel beyond the position of said first mandrel during the completion of the bend.

* * * * *